US005924627A

United States Patent [19]

Wilder et al.

[11] Patent Number: 5,924,627

[45] Date of Patent: Jul. 20, 1999

[54] PACKAGING BLANK AND CONTAINER MADE THEREFROM

[75] Inventors: Duane C. Wilder, Chesterfield; Michael J. Pollio, Richmond, both of Va.

[73] Assignee: Philip Morris Incorporated, Richmond, Va.

[21] Appl. No.: 08/908,317

[22] Filed: Aug. 7, 1997

[51] Int. Cl.[6] ..... B65D 5/42

[52] U.S. Cl. ..... 229/182.1; 206/273; 229/160.1; 229/930

[58] Field of Search ..... 229/4.5, 160.1, 229/182.1, 930; 206/268, 273

[56] References Cited

U.S. PATENT DOCUMENTS

| | | | |
|---|---|---|---|
| 1,420,001 | 6/1922 | Wagner | 229/198.1 |
| 1,482,569 | 2/1924 | Lange | 229/930 |
| 3,059,551 | 10/1962 | Dunham . | |
| 3,526,566 | 9/1970 | McIlvain, Jr. et al. | 229/930 |
| 3,708,108 | 1/1973 | Rosenburg, Jr. . | |
| 4,373,929 | 2/1983 | Smith | 229/930 |
| 4,708,704 | 11/1987 | Focke et al. . | |
| 4,753,383 | 6/1988 | Focke et al. . | |
| 4,955,531 | 9/1990 | Graboyes | 229/4.5 |
| 5,044,550 | 9/1991 | Lamm . | |
| 5,064,409 | 11/1991 | Campbell et al. . | |
| 5,073,162 | 12/1991 | Campbell et al. . | |
| 5,307,925 | 5/1994 | Focke et al. . | |
| 5,341,925 | 8/1994 | Fleenor et al. . | |
| 5,392,905 | 2/1995 | Focke et al. | 206/268 |
| 5,435,440 | 7/1995 | Focke et al. . | |

*Primary Examiner*—Gary E. Elkins
*Attorney, Agent, or Firm*—Connolly & Hutz

[57] ABSTRACT

A packaging blank is scored with several substantially parallel laterally spaced apart score lines adjacent the intended location of a rounded edge on the container produced from the blank. The score lines are formed on the inside surface of the blank which places the score lines inside the container formed from the blank. When the blank is bent into shape at the rounded edges, a portion of the total deflection is absorbed by each score line whereby the resulting container edge is a gradual curve rather than a single sharp crease. Placing the score lines on the inside of the formed container results in opposing faces of the container being planar and parallel to one another.

8 Claims, 2 Drawing Sheets

PACKAGING BLANK AND CONTAINER MADE THEREFROM

BACKGROUND OF THE INVENTION

The present invention relates to a packaging blank for forming containers with curved or rounded edges.

Many consumers prefer to purchase cigarettes and other products in boxes rather than soft packages. Among the reasons for this preference is the fact that a box tends to protect its contents somewhat better than a soft package. One disadvantage of boxes, however, is that they may have sharper and stiffer edges than a soft package. This may increase the wear on accessories (e.g., handbags) or articles of cloth (e.g., shirt pockets) in which the box is carried. Many customers have also been found to prefer the "softer" feel of containers with curved or rounded edges.

U.S. Pat. Nos. 4,955,531, 5,064,409 and 5,073,162 describe a container blank having a plurality of parallel, closely spaced score lines formed on the outside surface of the blank at the intended location of each curved or rounded edge. When the blank is subsequently bent to form the container, some of the bending deflection occurs at each score line on the outside surface. Accordingly, the overall bending deflection is distributed over the outside score lines, with the result that the edge is gradual or rounded, as desired.

However, the gradual or rounded edges of the prior art containers have at least one disadvantage in that these rounded edges tend to slightly open after the blank is bent into container shape. Such opening of the rounded edges tends to outwardly bow the opposite sidewalls of the formed container which makes container closure more difficult.

Furthermore, the high speed processing required for manufacture of large quantities of quality product requires a minimum of frictional engagement between the product and the machinery which is acting on the product. This is so for many reasons, including wear and tear on the high-speed machine parts, energy losses through excess frictional losses, and damage to the product as it passes through the high-speed apparatus.

Appearance of a consumer good is of extreme importance to a discriminating consumer. If a package has damaged overwrap, packaging with tears or crimps in the cardboard, or obvious wearing along edges, it is most likely to be rejected by a consumer.

With the elimination of the bowing of the side walls of rounded-corner packages, much of this friction is reduced. This allows for easier transit of the package along the wrapping and cartoning processes, reduces wear and tear along the indicia or advertising on the package surfaces, and causes a freer flow of the product. This freer flow may result in fewer jams, and the resultant stoppage of work with concomitant losses in productivity generated thereby.

SUMMARY OF THE INVENTION

One of the objects of the present invention is a packaging blank for producing a container with rounded edges and parallel opposing side walls.

Another object of the present invention is a container with rounded edges formed from score lines on the inside of the container adjacent the intended location of the rounded edges.

In accordance with the present invention, a particular packaging blank is used in the formation of a container having at least one curved edge with a longitudinal axis. A plurality of longitudinal, substantially parallel, laterally spaced score lines on the inside surface of the blank and inside the container formed thereby function to form the curved edge. Each of the score lines has a longitudinal axis substantially parallel to the longitudinal axis of the edge. When the blank is bent around the longitudinal edge axis, the blank bends at each score line and the edge is therefor curved by virtue of the bending deflection distributed over the score lines.

Preferably, the blank has a predetermined uniform thickness. Also, the blank includes front and back panels forming front and back side walls of the formed container. It is significant that the front and back container side walls are planar and parallel to one another, and further that such parallel relationship is maintained.

BRIEF DESCRIPTION OF THE DRAWINGS

Novel features and advantages of the present invention in addition to those mentioned above will become apparent to persons of ordinary skill in the art from a reading of the following detailed description in conjunction with the accompanying drawings wherein similar reference characters refer to similar parts and in which.

DETAILED DESCRIPTION OF THE INVENTION

Figure 1:
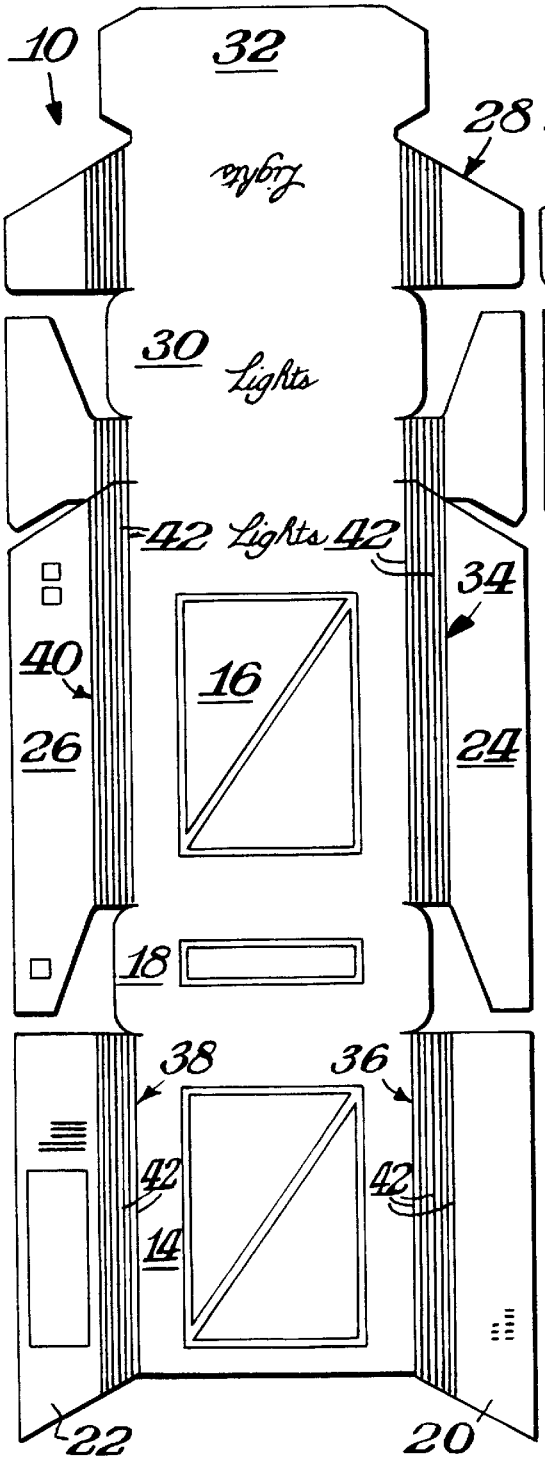
Fig. 1 (Prior Art)
FIG. 1 is a plan view of the outside surface of a prior art cigarette packaging blank.
Figure 2:
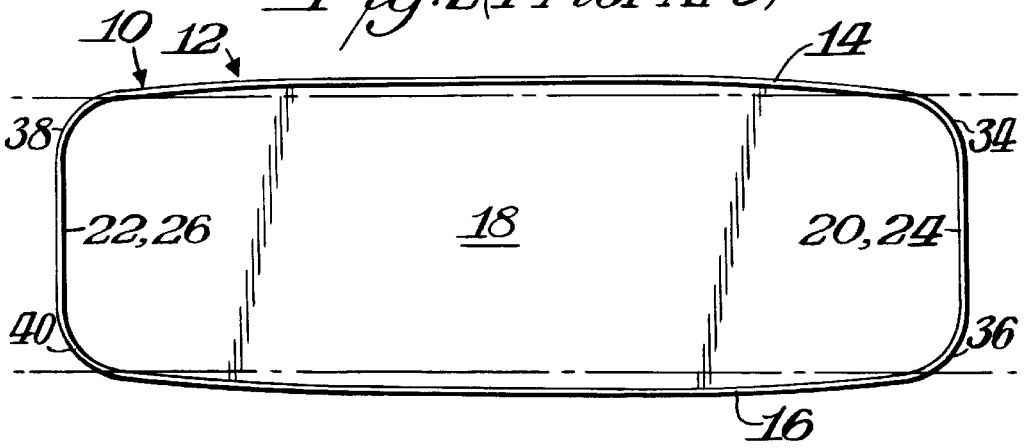
Fig. 2 (Prior Art)
FIG. 2 is a cross-sectional view of a cigarette container formed from the blank shown in FIG. 1.
Figure 3:
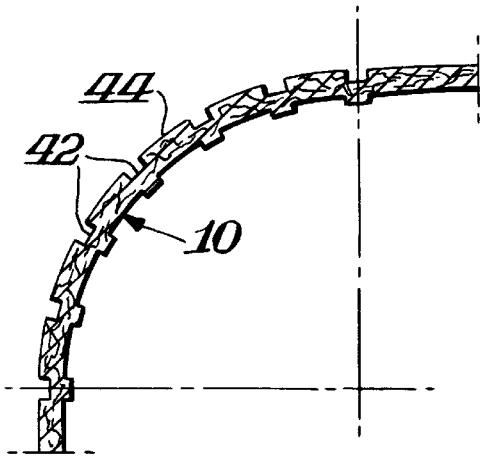
Fig. 3 (Prior Art)
FIG. 3 is an enlarged fragmental cross-sectional view through one of the four corners of a cigarette container formed from the blank shown in FIG. 1.
Figure 6:
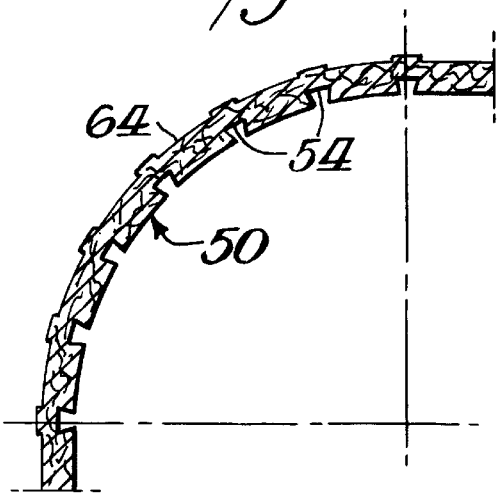
FIG. 6 is an enlarged fragmental cross-sectional view through one of the four corners of a cigarette container formed from the blank shown in FIG. 4.

Referring in more particularly to the drawings, FIGS. 1–3 illustrate the prior art where a typical packaging blank 10 is utilized to form a cigarette container box 12. Blank 10 includes a front panel 14 and a back panel 16 integrally connected together by a bottom panel 18. A right side panel 20 and a left side panel 22 are integrally connected to the front panel, as shown best in FIG. 1. Similarly, a right side panel 24 and a left side panel 26 are integrally connected to the back panel. Container closure panels 28 including a top 30 and a closure flap 32 are integrally connected to back panel 16.

In the finished container box 12 made from blank 10, the panels 14, 16 and 18 are bent or folded so that the front and back panels 14 and 16 are generally parallel to one another. The right and left side panels 20, 22, 24 and 26 are also bent or folded to positions generally parallel and generally perpendicular to the front and back panels. The right side panels 20, 24 are glued or otherwise secured together, and the left side panels 22, 26 are secured together in like manner. The container closure panels at the top of the container box are also folded into shape and assembled in any known manner.

At the intended locations of each of the four vertical edges 34, 36, 38 and 40 of box 12, blank 10 has a plurality of score lines 42 extending along most of the height of the blank parallel to the longitudinal axis of the associated intended edge. These score lines are produced on the outside surface of blank 10 and therefore on the outside of the finished container box 12. Six parallel, laterally spaced score lines 30 may be provided at the location of each intended vertical edge. All of score lines 42 are preferably identical to one another, and within each group the score lines are preferably evenly spaced from one another.

As a result of the presence of score lines 42, when blank 10 is bent or folded during assembly of container box 12 about the longitudinal axis of any of the intended vertical edges of the box, a gradual or rounded edge 44 automatically results. This is because each of score lines 42 absorbs a portion of the total bending deflection whereby the total deflection is distributed among the score lines 42. As a result, the edge curvature is spread out along the width of the scored region, which becomes a gradual arc rather than a sharp crease or fold.

The present invention bears some similarity to the above-described prior art but is significantly different in at least one major respect. For the purpose of describing the invention herein, similar reference characters have been utilized to identify similar parts.

Figure 4:
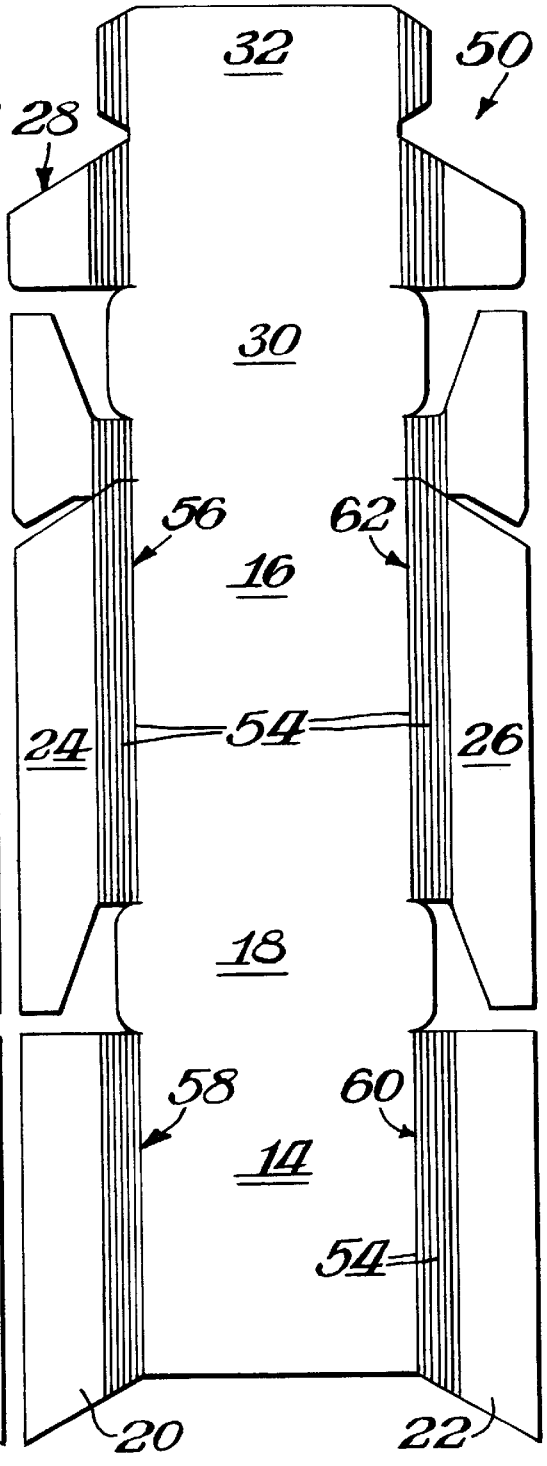
FIG. 4 is a plan view of the inside surface of a cigarette packaging blank, according to the present invention.
Figure 5:
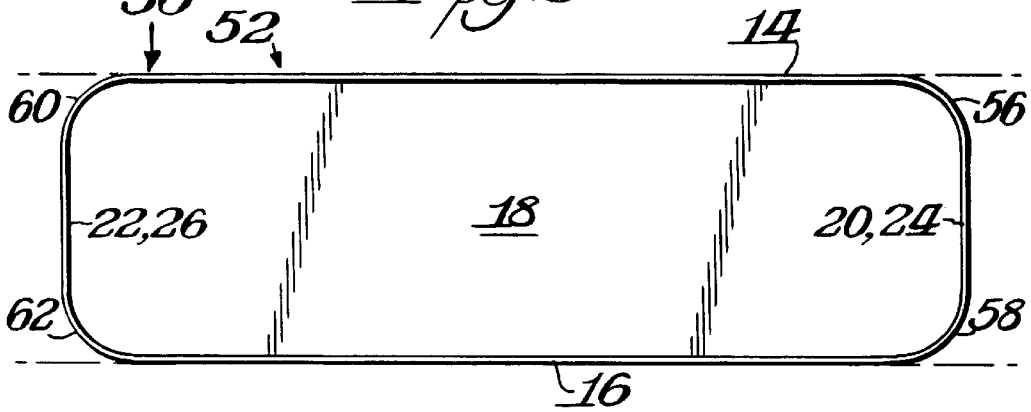
FIG. 5 is a cross-sectional view of a cigarette container formed from the blank shown in FIG. 4.

The present invention comprises a packaging blank 50, as shown best in FIG. 4. The various regions of the blank 50 function to form a container box 52 for cigarettes. Portions of the formed container box are illustrated in FIG. 5. The various regions of blank 50 are similar in design and contour to the corresponding regions in the blank 10 of the prior art. However, blank 50 does not include any score lines on the outside surface of the blank or on the outside faces of the formed container box 52. Instead, score lines 54 are placed on the inside surface of the blank and therefore on the inside of container box 52 formed from blank 50.

A typical material for blank 50 is 0.012" thick cardboard, but any other suitable material of any desired thickness and/or size could alternatively be employed. Moreover, scoring the inside surface of the blank may be accomplished by apparatus well known in the art including but not limited to the apparatus and processes described and shown in U.S. Pat. Nos. 4,955,531, 5,064,409 and 5,073,162, incorporated herein by reference.

At the intended locations of each of the four vertical edges 56, 58, 60 and 62 of container box 52, blank 50 has a plurality of the score lines 54 generally extending along the length of the blank parallel to the longitudinal axis of an associated intended edge. Six or seven parallel, laterally spaced score lines 54 may be provided at the location of each intended vertical edge. These score lines are produced on the inside surface of blank 50, and therefore on the inside of finished container box 52. All of the score lines 54 are preferably identical to one another, and within each group, the score lines are preferably evenly spaced from one another.

When blank 50 is bent or folded during assembly of container box 52 about the longitudinal axis of any of the intended vertical edges 56, 58, 60 and 62, a gradual or rounded edge 64 automatically results. This is because each of the score lines 54 absorbs a portion of the total bending deflection whereby the total deflection is distributed among the score lines 54. As a result, the edge curvature is spread out along the width of the scored region which becomes a gradual arc rather than a sharp crease or fold.

Placement of score lines 54 inside container box 52 produces front and back panels 14, 16 which are planar and parallel to one another. The tendency of the gradual or rounded edges 64 to open and thereby outwardly bow the front and back panels of the container 52 is substantially diminished by placement of the score lines on the inside surface of the blank and on the inside the container formed thereby.

The right side panels 20, 24 also remain parallel to the left side panels 22, 26 of container box 52. Closure of container box 52 is enhanced when the opposite sides of the container remain are parallel to one another.

What is claimed is:

1. A blank with inside and outside surfaces for use in forming a container having a curved edge with a longitudinal axis comprising a plurality of longitudinal, substantially parallel, laterally spaced score lines on the inside surface of the blank for forming the curved edge, each of the score lines having a longitudinal axis substantially parallel to the longitudinal axis of the edge whereby when the blank is bent about its longitudinal edge axis, the blank bends at each score line and the edge is therefore curved by virtue of the bending deflection being distributed over the plurality of score lines, wherein the score lines are located inside the formed container, and wherein the curved edge has substantially equal inner and outer curvatures.

2. The blank as in claim 1 wherein the blank has a predetermined uniform thickness.

3. A blank as in claim 1 wherein the blank includes a front panel and a back panel forming front and back faces of the container, and wherein the front and back faces of the formed container are planar and parallel to one another.

4. A blank with inside and outside surfaces for use in forming a container having curved edges comprising:

a front panel integrally connected to a left side panel, a right side panel, and a bottom panel;

a back panel integrally connected to a second left side panel, a second right side panel, the bottom panel, and a container top portion;

wherein between the front panel and each side panel integrally connected therewith, and between the back panel and each second side panel integrally connected therewith are formed a plurality of longitudinal, substantially parallel, laterally spaced score lines on the inside surface of a blank, whereby when the blank is bent about the score lines, edges of the container between the front panel and each side panel integrally connected therewith are curved, and edges of the container between the back panel and each second side panel integrally connected therewith are curved, and the score lines forming the curved edges are located inside the formed container.

5. A blank as in claim 4 wherein the container top portion comprises a top integrally connected with front and rear closure panels, each of the front and rear closure panels having side panels integrally connected therewith by a plurality of longitudinal, substantially parallel, laterally spaced score lines on the inside surface of the blank, whereby when the top portion is formed, edges of the top portion between the closure panels and each side panel integrally connected therewith are curved.

6. A container having rounded longitudinal edges comprising:

a front face integrally connected to a right face, a left face, and a bottom face, a back face integrally connected to the right face, the left face, the bottom face and a closure portion, wherein the right and left faces are parallel to each other, the front and back faces are parallel to each other, and the front and back faces are integrally connected to the left and right faces by a plurality of longitudinal, substantially parallel, laterally spaced score lines on the inside surface of the container, whereby curved edges are formed between adjacent faces of the container.

7. A container as claimed in claim 6 wherein the closure portion comprises a top integrally connected with front and rear closure panels, each of the front and rear closure panels integrally connected to sidewalls by a plurality of longitudinal, substantially parallel, laterally spaced score lines on the inside surface of the closure portion, whereby curved edges are formed in the top portion of the container.

8. A closure as claimed in claim 7 wherein inflection of the sides forms an inward bowing.

* * * * *